US005477913A

United States Patent [19]

Polk et al.

[11] Patent Number: 5,477,913

[45] Date of Patent: Dec. 26, 1995

[54] SYSTEM FOR CONTROLLING A HEATING/AIR CONDITIONING UNIT

[75] Inventors: Steven A. Polk, Farmington Hills; Bruce E. Stuckman, Troy, both of Mich.

[73] Assignee: Homer, Inc., Southfield, Mich.

[21] Appl. No.: 51,629

[22] Filed: Apr. 22, 1993

[51] Int. Cl.[6] ..... F25B 29/00; F23N 5/24; F24H 3/00

[52] U.S. Cl. ..... 165/12; 431/16; 431/22; 126/116 A

[58] Field of Search ..... 431/22, 16; 165/12; 126/116 A

[56] References Cited

U.S. PATENT DOCUMENTS

| | | | |
|---|---|---|---|
| 4,299,554 | 11/1981 | Williams . | |
| 4,893,113 | 1/1990 | Park et al. . | |
| 4,916,437 | 4/1990 | Gazzaz . | |
| 5,039,006 | 8/1991 | Habegger | 431/22 |
| 5,239,980 | 8/1993 | Hilt et al. | 431/22 |

FOREIGN PATENT DOCUMENTS

| | | |
|---|---|---|
| 58-182032 | 10/1983 | Japan . |
| 62-225829 | 3/1987 | Japan . |
| 62-138654 | 6/1987 | Japan . |
| 63-3122 | 8/1988 | Japan . |
| 1137115 | 5/1989 | Japan . |
| WO9115716 | 10/1991 | WIPO . |

*Primary Examiner*—John K. Ford
*Attorney, Agent, or Firm*—Brooks & Kushman

[57] ABSTRACT

This invention relates to a method and system for controlling a heating/air conditioning unit. More particularly, this invention relates to a control unit which detects the presence of one or more gases (e.g. CO, fuel, refrigerant or rador) produced by the heating/air conditioning unit and disables the heating/air conditioning unit if gases are present in undesired concentrations. In one embodiment of the present invention, the presence of multiple gases are detected and a separate indication for each gas is provided. An alternate embodiment of the present invention provides means for resetting the heating/air conditioning unit a selected number of times after the heating/air conditioning unit has been disabled due to the presence of a gas in undesired levels. An alternative embodiment of the present invention provides means for disabling the central heating/air conditioning unit based upon the activation of one or more smoke alarms. Further, the present invention provides means for detecting inefficient combustion or other inefficient operation of the heating or heating/air conditioning unit and indicating said inefficient operation to the user.

11 Claims, 11 Drawing Sheets

SYSTEM FOR CONTROLLING A HEATING/AIR CONDITIONING UNIT

TECHNICAL FIELD

This invention relates to a method and system for controlling a heating/air conditioning unit. More particularly, this invention relates to a control unit which detects the presence of one or more gases produced by the heating/air conditioning unit.

BACKGROUND ART

Many homes employ a heating unit which operates by the combustion of supplied gas, and the distribution of the heat produced to the various rooms in the home by a network of forced air ducts and air return ducts. These central heating units can, under certain operating conditions exhaust undesirable levels of supplied gas and gas which is a byproduct of combustion, such as carbon monoxide, into the forced air ducts.

Further, many central heating units operate in conjunction with a central air conditioning unit. These units generally operate by pumping heat from the house to an outdoor heatsink by means of a closed compression/evaporation system operating on a refrigerant. If a leak occurs in this closed system, refrigerant can be exhausted into the forced air ducts.

Prior art devices, such as the device disclosed in U.S. Pat. No. 4,893,113 issued to Park et al. are capable of detecting the presence of carbon monoxide in the air surrounding a heating unit and activating an alarm.

Further, Japanese patent number 62-225829 discloses a control device for a heating unit which calculates the concentration of carbon monoxide in the room the heating unit is placed in and terminates combustion based upon this calculated concentration. These prior art devices do not disable the heating unit in response to the detection of undesired gases.

SUMMARY OF THE INVENTION

The present invention solves the problems presented by the prior art by providing a control unit for a heating/air conditioning unit which detects the presence of undesired gases using a sensor placed in the forced air ducts and disables the heating unit if the undesired gases are present. The placement of a sensor within the forced air ducts enables the control unit to respond more quickly to the presence of undesirable gases since the concentration of gas in the ducts is initially higher than the concentration in the rooms.

An object of the present invention is to detect the presence of multiple gases including supply gas and refrigerant and provides a separate indication for each gas. This indication can aid in the diagnostic procedure during servicing of the heating/air conditioning unit.

A further object of the present invention is to provide disabling of the central heating/air conditioning unit after a preset number of faults. Means are provided for reset of the control unit only upon actions taken by knowledgeable service personnel. This prevents the user from continually resetting the heating/air conditioning unit based upon continuing fault conditions.

Moreover, an object of the present invention is to provide a means for disabling the central heating/air conditioning unit based upon the activation of one or more smoke alarms.

An additional object of the present invention is to provide a means for indicating inefficient combustion in a heating/air conditioning unit—detected by measuring the pressure of higher than normal levels of exhaust gases.

In carrying out the present invention a method for controlling a heating unit operating by the combustion of a supply gas having a forced air duct is provided. The method comprises the steps of sensing the concentration of a first gas in a forced air duct, comparing the first gas concentration to a selected first threshold, and disabling the heating unit if the first gas concentration is above the first threshold.

Further, a control system for a heating/air conditioning unit operating by the combustion of a supply gas and by the compression of a refrigerant, wherein the heating/air conditioning unit has a forced air conduct is provided. The system comprises a gas sensor placed in a position so as to sample the air in the forced air duct. The sensor generates an electrical signal as a function of the concentration of a first gas in the forced air duct. First comparison means responsive to the electrical signal are provided for comparing the first gas threshold concentration to a selected first threshold and for generating an output signal indicative of whether the first gas concentration is above the first threshold. First control means responsive to the output signal are also provided for disabling the heating unit at the first gas concentration is above the first threshold.

Moreover, a method for controlling a heating unit operating by the combustion of a supply gas is provided. The method comprises the steps of sensing the concentration of a plurality of gases in proximity to the heating unit, comparing the concentration of each of the plurality of gases to a respected selected threshold and disabling the heating unit if at least one of the plurality of gas concentration is above the respective threshold.

In addition, a control system for a heating/air conditioning unit or forced air system is provided. The system comprises means for monitoring a smoke alarm having an alarm status and for generating an alarm signal indicative of the alarm status, and control means responsive to the alarm signal for disabling the heating unit or forced air system if the smoke alarm indicates an alarm status.

BEST MODE FOR CARRYING OUT THE INVENTION

Figure 1:
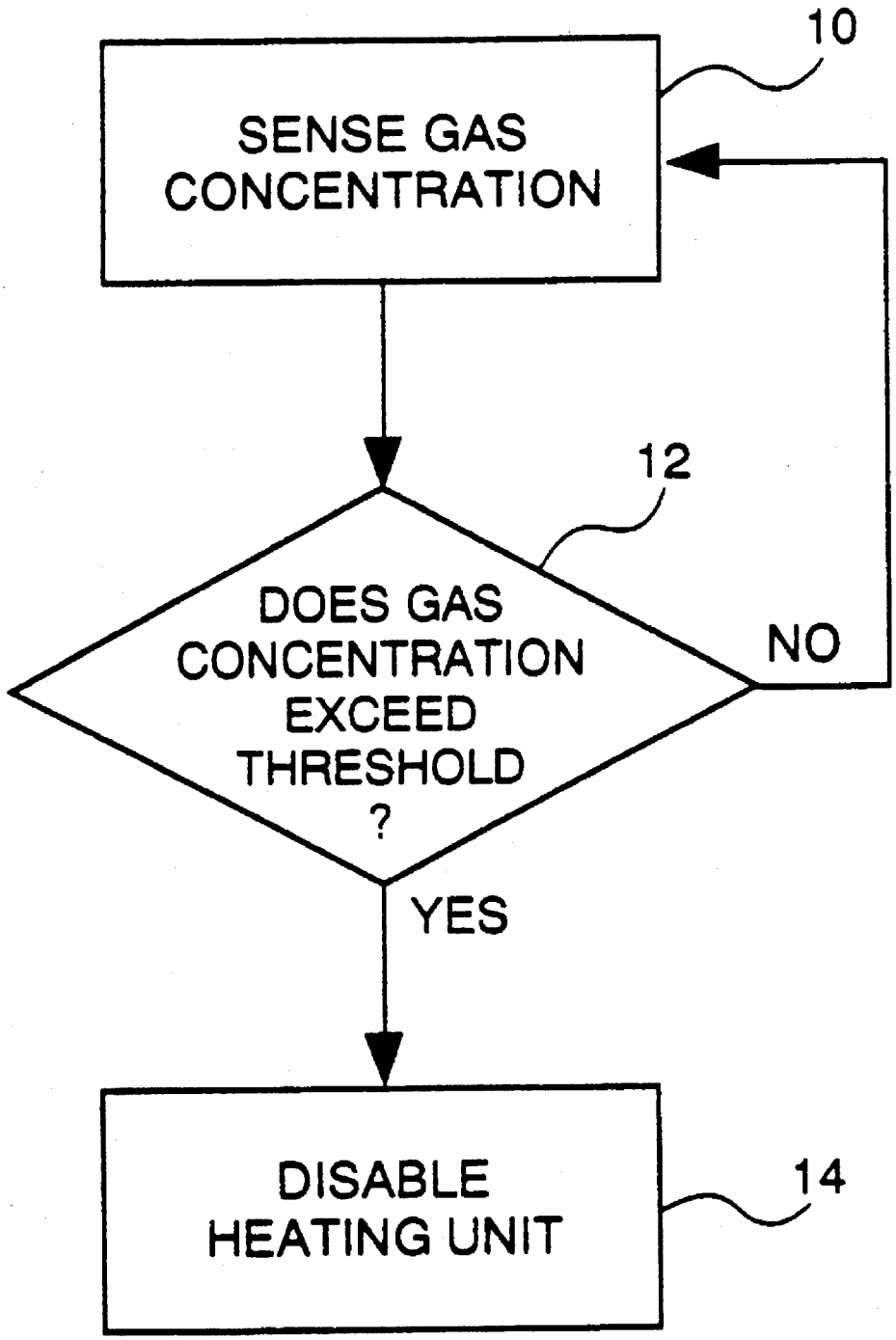
FIG. 1 is a flow chart representation of one embodiment of the present invention.

Referring to FIG. 1, a flow chart representation of one embodiment of the method of the present invention is shown. The concentration of a selected gas is sensed in proximity to a heating or heating/air conditioning unit as shown in step 10. This gas concentration is compared with a selected threshold as shown in step 12. If the gas concentration exceeds the selected threshold, the heating unit or heating/air conditioning unit is disabled as shown in step 14. If however, the gas concentration does not exceed the threshold, the gas concentration is continued to be sensed as shown in step 10.

The selected gas to be sensed could be carbon monoxide, radon or other potentially harmful gases. The selected gas to be sensed could also be the supply gas used for combustion in a combustion-type gas heating unit or the gas produced by a liquid combustion fuel such as fuel oil vapor. Further, the selected gas to be sensed could be the refrigerant used for air conditioning in a heating/air conditioning unit.

It should also be noted that the gas could be sensed in an area immediately adjacent to the heating or heating/air conditioning unit. Alternately, the gas could be sensed within the forced air ducts of a forced air heating or heating/air conditioning unit. The sensing of gas in these regions provides rapid detection of higher than normal concentrations of the selected gas.

The selected threshold could correspond to a selected gas concentration which would be harmful to persons serviced by the heating or heating/air conditioning unit. Moreover, the selected threshold could correspond to a selected gas concentration representative of inefficiency or improper combustion present in the heating or heating/air conditioning unit. Particularly, the presence of refrigerant could indicate the presence of a leak in an air conditioning unit. Further, the presence of supply gas or carbon monoxide at above normal concentrations would correspond to incomplete or improper combustion in a combustion-type heating unit.

Moreover, the selected threshold could vary with the sample interval. Given the sensing of carbon monoxide, for a sample interval of one minute, a concentration of 300 ppm might be used and for a sample interval of 5 minutes a concentration of 100 ppm might be used.

Figure 2:
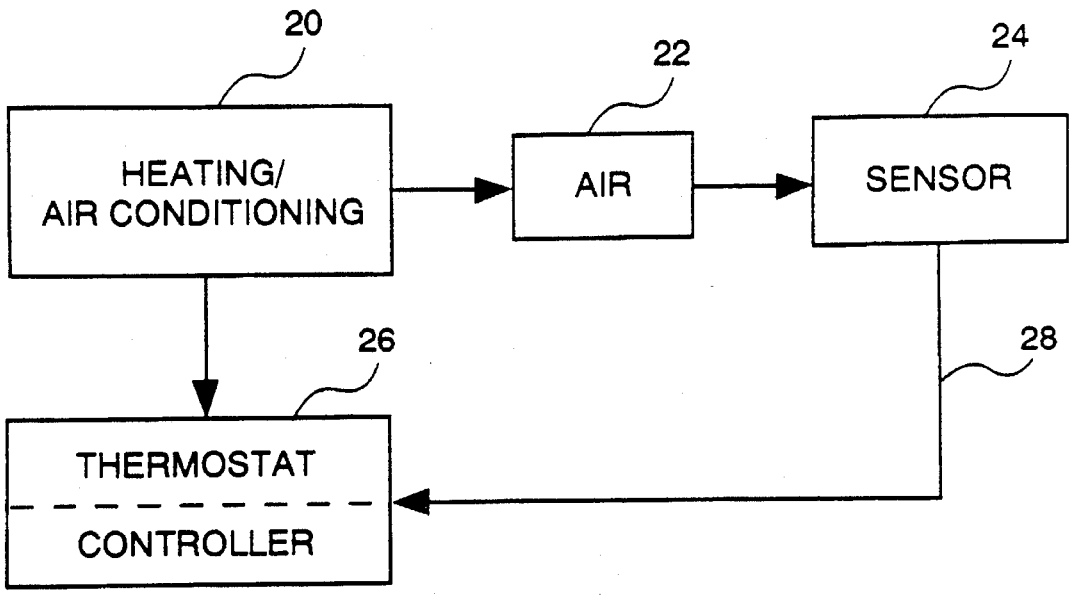
FIG. 2 is a block diagram representation of one embodiment of the system of the present invention.

Turning now to FIG. 2, a block diagram representation of one embodiment of the system of the present invention is shown. The air 22 in proximity to heating/air conditioning unit 20 is sensed via gas sensor 24. Gas sensor 24 determines the concentration of a selected gas and compares that concentration to a selected threshold. An electrical signal is coupled via line 28 to thermostat/controller 26. This unit 26 contains the elements of a standard thermostat for a heating/air conditioning unit. Additionally, unit 26 contains controller circuitry which is responsive to the electrical signal generated by gas sensor 24 which disables the operation of the heating/air conditioning unit 20 based upon a gas concentration above the selected threshold.

Figure 3:
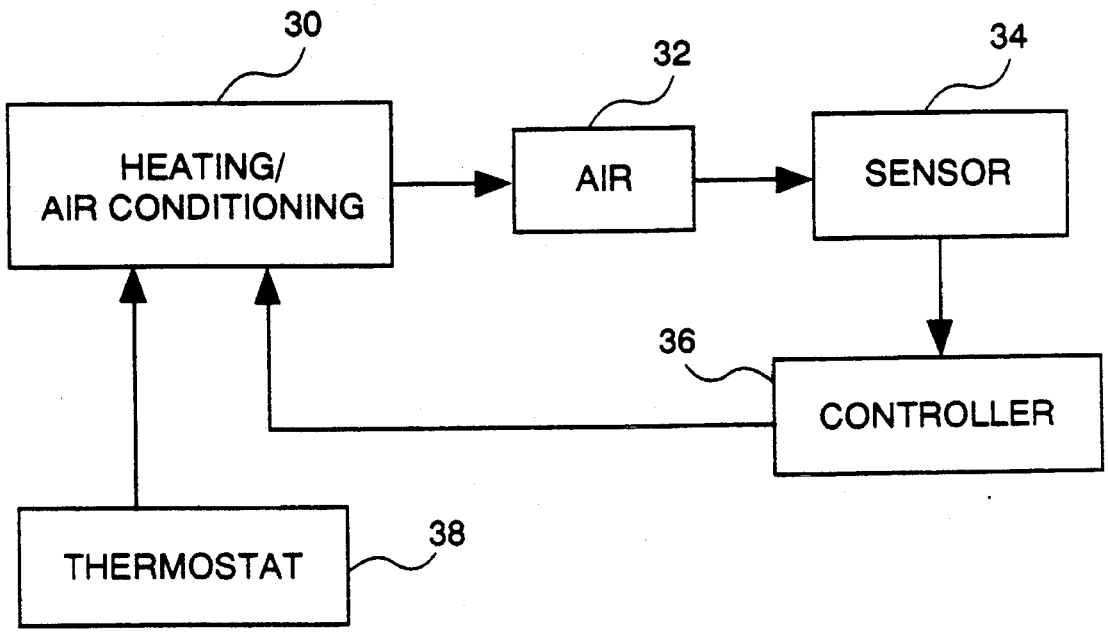
FIG. 3 is a block diagram representation of an alternate embodiment of the system of the present invention.

Turning now to FIG. 3, an alternate embodiment of the system of the present invention is shown. The air 32 in proximity to heating unit 30 is sensed by gas sensor 34 in a manner similar to the embodiment of the present invention shown in FIG. 2. However, the thermostat/controller unit 26 of FIG. 2 is shown as two separate units, thermostat 38 and controller 36. Thermostat 38 performs all of the functions associated with a normal heating/air conditioning unit thermostat including the activation of the heating unit upon a drop in temperature below the user selected temperature threshold if the heating mode is selected, and the activation of the air conditioning unit upon a temperature rise above a user selected temperature threshold if the thermostat is in the cooling mode. Controller 36 accepts an electrical signal generated by sensor 34 indicative of whether or not the gas concentration is above the selected threshold. The presence or absence of this signal is used to trigger the disabling of heating/air conditioning unit 30.

In any of the embodiments presented, a display could be included. This display could indicate such parameters as the current gas concentration level, the peak gas concentration which triggered a disabling of the heating or heating/air conditioning unit or more generally the status of the controller in a "normal" or "disabled" mode.

It should be noted from the configuration in FIG. 3 that controller 36 can be located separately from thermostat 38. Thus, controller 36 could be located for instance, in close proximity to the heating/air conditioning unit 30 or the sensor 34.

Figure 4:
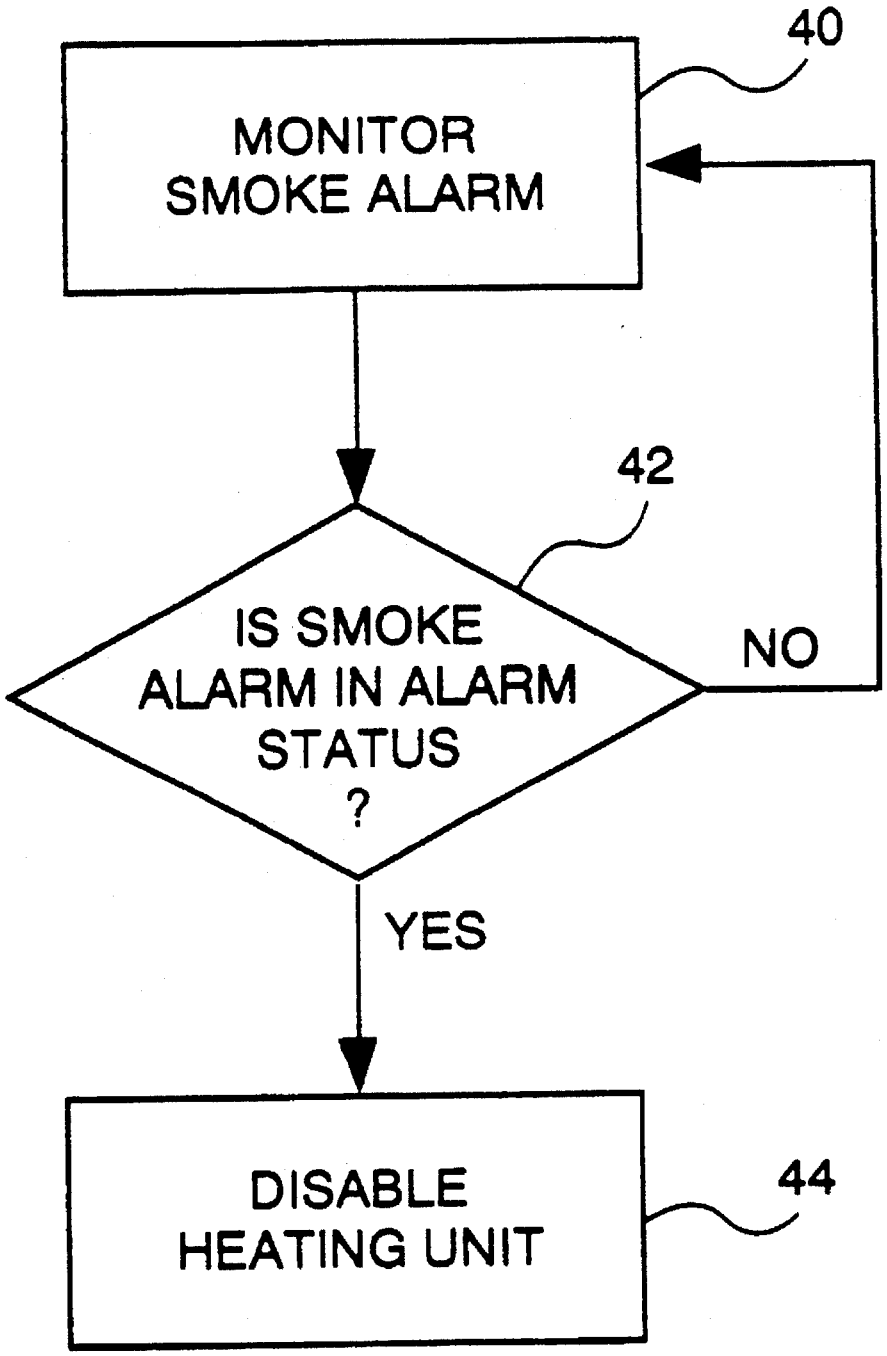
FIG. 4 is a flow chart representation of an alternate embodiment of the present invention.

Turning now to FIG. 4, a flow chart representation of one embodiment of the method of the present invention is presented. In this embodiment, monitor 40 monitors the alarm status of one or more smoke alarms which are located in proximity to a heating unit or directly within the forced air ducts in a forced-air system. If one or more of the smoke alarms are determined to be in the alarm status—indicating that a presence of smoke has been detected by the smoke alarms—then the heating unit is disabled as shown in block 44. If however, none of the smoke alarms are determined to be in an alarm status, the present invention continues to monitor smoke alarms as indicated by block 42 and block 40.

The operation of the present invention, in detecting the alarm status of one or more smoke alarms and disabling a heating unit based upon this alarm status, provides an important function. The operation of a forced air heating or heating/air conditioning unit during a fire, can serve to promote the spreading of the fire by means of the air movement produced. Further, in certain circumstances, the operation of a forced air heating or heating/air conditioning unit during a fire can serve to supply additional oxygen to an existing fire which has the effect of increasing the magnitude of the fire in progress. Moreover, the operation of a forced-air system during a fire can cause smoke damage throughout a building by transporting smoke to areas uneffected by the fire.

Figure 5:
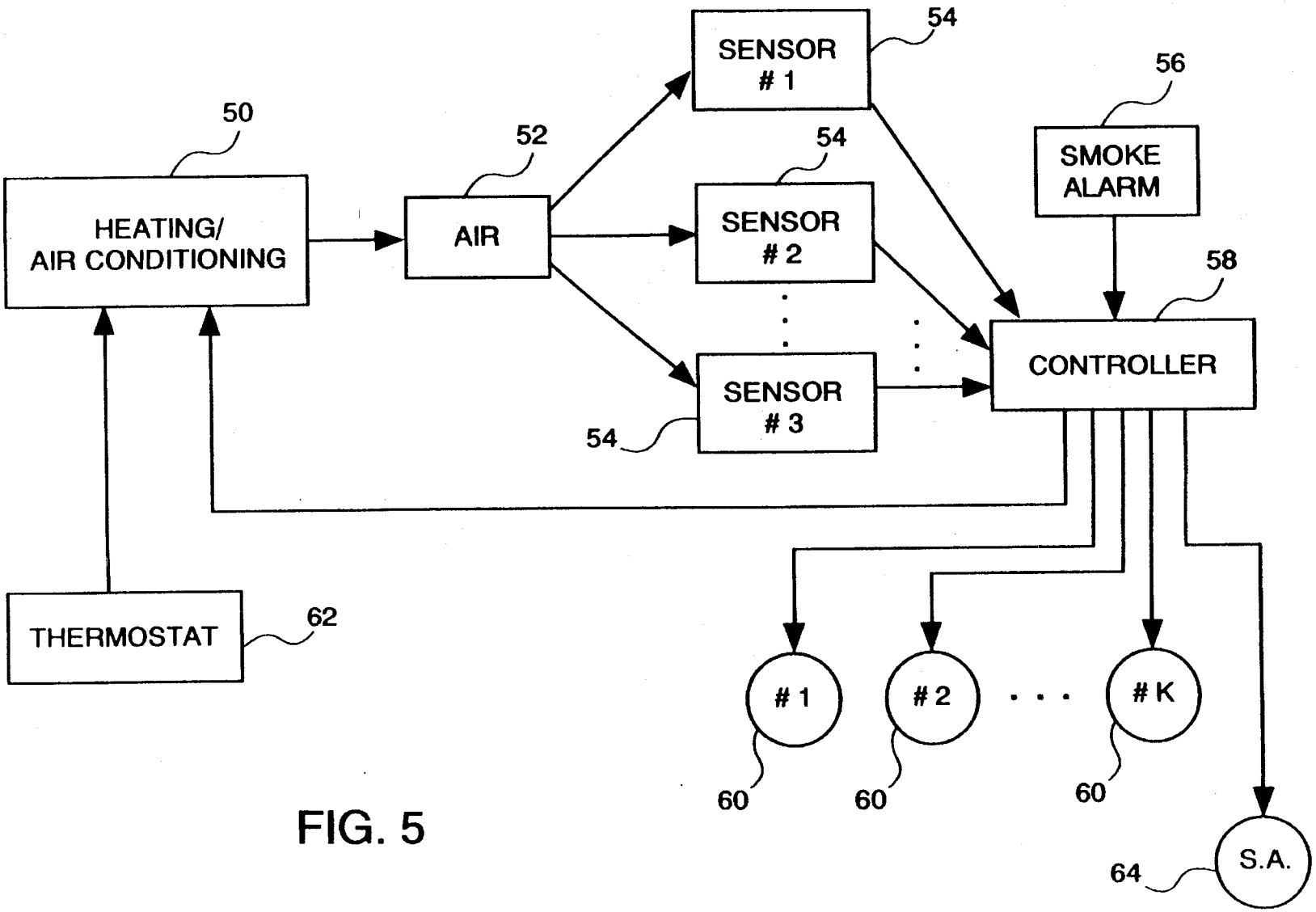
FIG. 5 is a block diagram representation of an alternate embodiment of the system of the present invention.

Turning now to FIG. 5, a block diagram representation of an alternate embodiment of the system of the present invention is presented. The air 52 in proximity to heating/air conditioning unit 50 controlled by thermostat 62 is sensed by means of sensors 1-K 54. This plurality of sensors 54 is used to detect the presence of a plurality of different gas in proximity to heating/air conditioning unit 50. Specifically, each sensor 54 is present to detect the concentration of a respective gas. Alternatively, each of the respective sensors 54 could produce an electrical output signal to controller 58 based upon differing thresholds for a common gas.

Controller 58 disables heating/air conditioning unit 50 based upon the detection of an alarm status from smoke alarm 56, or based upon the exceeding of one or more thresholds for the gas concentration for one or more gases as detected by sensors 54.

Indicators 1-K 60 provide an indication of the status of each of the sensors 1-K 54. By this means, if heating/air conditioning unit 50 is disabled by controller 58, a user could determine which of the plurality of sensors caused the respective fault condition. For instance, if the sensors 54 corresponded to different gases, a user could determine which gas was present in unacceptable levels so as to cause the disabling of heating/air conditioning unit 50. Further, indicator 64 is provided to indicate a fault condition triggered by smoke alarm 56.

It should be noted that a wide variety of different display/indication means could be used to implement indicators 60 and 64. In the preferred embodiment, a duo-chromatic light-emitting diode would be used to provide this indication. If the light-emitting diode were a first color, this would indicate that the status of each of the sensors and the smoke alarm were normal—meaning that the smoke alarm was not in the alarm status, and each of the sensors was not detecting a gas concentration above the respective threshold. The second color of the light-emitting diode would correspond to a fault condition for its corresponding sensor or smoke alarm.

Those with ordinary skill in the art will recognize that a wide variety of different sensors could be used in the present invention. For instance, the use of metallic oxide semiconductor sensors for the detection of various gases and vapors is well known. For many years, a Japanese company, Figaro Engineering Company Incorporated of Osaka, Japan, has been manufacturing and marketing a family of such sensors based upon tin oxide for gas detection as described in U.S. Pat. No. 3,676,820.

In practice, the resistance of the tin oxide is measured, usually while it is heated. The resistance of the sensor changes dramatically when even small amounts of organic vapors, carbon monoxide, or even water vapor are present. U.S. Pat. No. 4,896,143 further describes a gas concentration sensor with dose monitoring which cancels the effects of ambient temperature and humidity in calculating the concentration of carbon monoxide. By this means, an integer value is generated which is proportional to the concentration of the sensed gas in parts per million. Further, the patent discloses a system whereby an alarm is issued if the concentration value reaches a predetermined level. The triggering of a binary signal in response to this alarm condition, could be used in the present invention to perform the functions described by any of the sensors described previously.

One with ordinary skill in the art will also recognize that sensors of this type can be used to generate a logic signal which is indicative of a spectrum of different gas thresholds based upon a corresponding measurement time interval. For instance, a gas sensor can easily be sent to trigger a binary signal if a concentration of gas is a first selected level for a first selected time period. A second concentration level for a second selected time interval, and a third concentration level at a third selected time interval. This mode of operation is referred to as a "dosed-type sensing mode" as one of ordinary skill in the art will recognize.

One such dosed type sensor is produced by Asahi Electronics, Inc. of Markham, Ontario. The Asahi COS-200B sensing unit operates with a 9-volt DC alkaline battery. The sensor measures gas conditions at six minute intervals and generates a latch on alarm condition which could easily be adapted to generate a binary logic signal in a case where: (1) the sensor is exposed to 120 parts per million to 200 parts per million of carbon monoxide gas for more than 30 minutes; (2) the sensor is exposed to 200 parts per million to 300 parts per million carbon monoxide gas for more than 18 minutes; (3) the sensor is exposed to 300 parts per million to 400 parts per million carbon monoxide gas for more than 12 minutes; or (4) the sensor is exposed to more than 400 parts per million carbon monoxide gas for more than six minutes. One of ordinary skill in the art will recognize that the signal from the sensor which illuminates its LED output could easily be adapted for the generation of a binary logic signal necessary for performing the functions of the sensor in the present invention.

One with ordinary skill in the art will further recognize that a wide variety of other gas sensor and gas sensor units could be used to perform the functions of the previously described sensor of the present invention. Such gas sensors exist to measure the concentrations of not only carbon monoxide, but carbon dioxide, oxygen and a wide variety of hydrocarbons, halogens and other gases.

Figure 6:
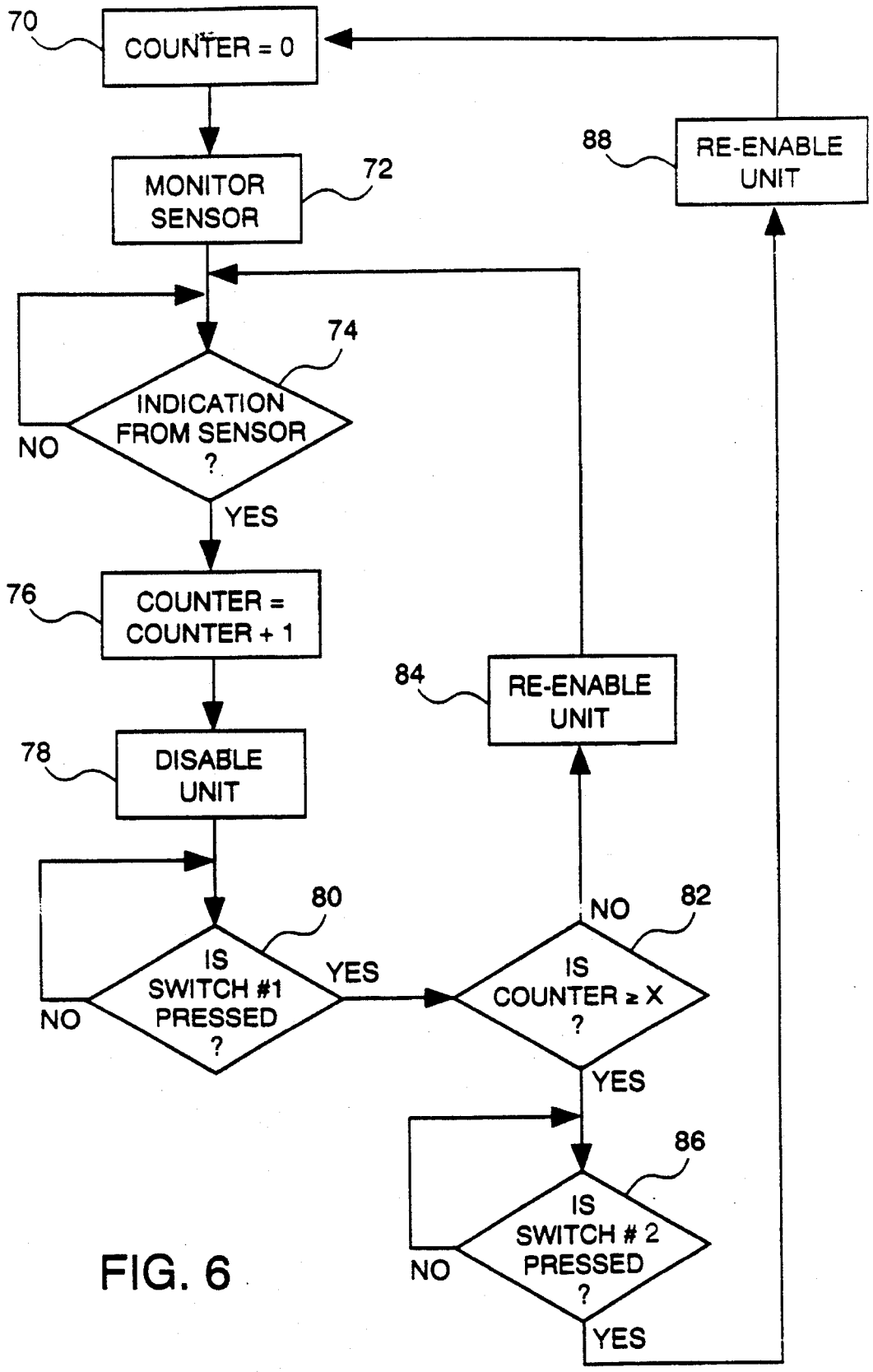
FIG. 6 is a flow chart representation of an alternate embodiment of the method of the present invention.

Turning now to FIG. 6, a flow chart representation of an alternate embodiment of the method of the present invention is presented. After the heating or heating/air conditioning unit has been disabled by the controller of the present invention, due to the detection of alarm status in the smoke alarms or the presence of a gas concentration above a selected threshold, the heating or heating/air conditioning unit can be reenabled by the user. However, after the heating or heating/air conditioning unit is disabled X times by the controller, it can only be reenabled by the activation of a separate switch.

In reference to FIG. 6, a counter is initially set to zero as indicated by step 70. The output from the sensor or sensors or smoke alarm is monitored as shown in step 72. If one of these sensors yields a logic high output indicating a gas concentration level above the selected threshold or indicating that one or more smoke alarms is in the alarm status as shown in step 74, the counter is incremented by one as shown in step 76. Furthermore, the heating or heating/air conditioning unit is disabled as shown in step 78.

The user has an opportunity to reenable the heating or heating/air conditioning unit by means of a first switch. The first switch is monitored as shown in step 80. If the switch is pressed, the counter value is checked to determine if it is greater than or equal to a selected value X as shown in step 82. If the counter value does not meet or exceed the value of X, the heating or heating/air conditioning unit is reenabled as shown in step 84. If however, the value of the counter meets or exceeds the value of X, the activation of a separate switch is required as shown in step 86 to reenable the heating or heating/air conditioning unit as shown in step 88.

The goal behind this aspect of the present invention is to only allow a user to reenable the heating or heating/air conditioning unit a selected number of times in the presence of a fault condition. The second switch could be designed or located in such a manner such that it would not be obvious to the user that the heating or heating/air conditioning unit could be reenabled in this manner. Rather, switch number two could only be activated by means known only to competent service personnel. Thus, the heating or heating/air conditioning unit user would not be able to continuously reenable the heating or heating/air conditioning unit if the controller were sensing gas concentration levels above a selected threshold. The user would be required to contact competent service personnel who would determine the cause of the fault and hopefully, correct the fault before the heating or heating/air conditioning unit were reenabled.

One with ordinary skill in the art will recognize that the second switch could be implemented in many ways. This second switch could be implemented with a magnetic reed switch activated by placing a magnet in proximity to the switch. A special key or tool could be required to activate the switch. Alternatively, an electronic key could be required—such as a resistor placed across two terminals.

The choice of the value of X could be based upon several factors. These factors include the type and nature of the heating or heating/air conditioning unit being controlled, the level of sophistication of a specific heating or heating/air conditioning unit user, the level of sophistication of a general heating or heating/air conditioning unit user, the respective gas concentration threshold set for the various gases being sensed, or based upon some other similar criteria.

In one modification of the embodiment of the present invention described above, any disabling of the heating unit which occurred more than a selected time Y from the present time, would not be counted in calculating X. Thus, a failure that happened a long time period previously, such as one week, would not count. However, if X failures occurred within a period shorter than Y, the heating unit would no longer respond to the first switch.

Figure 7A:
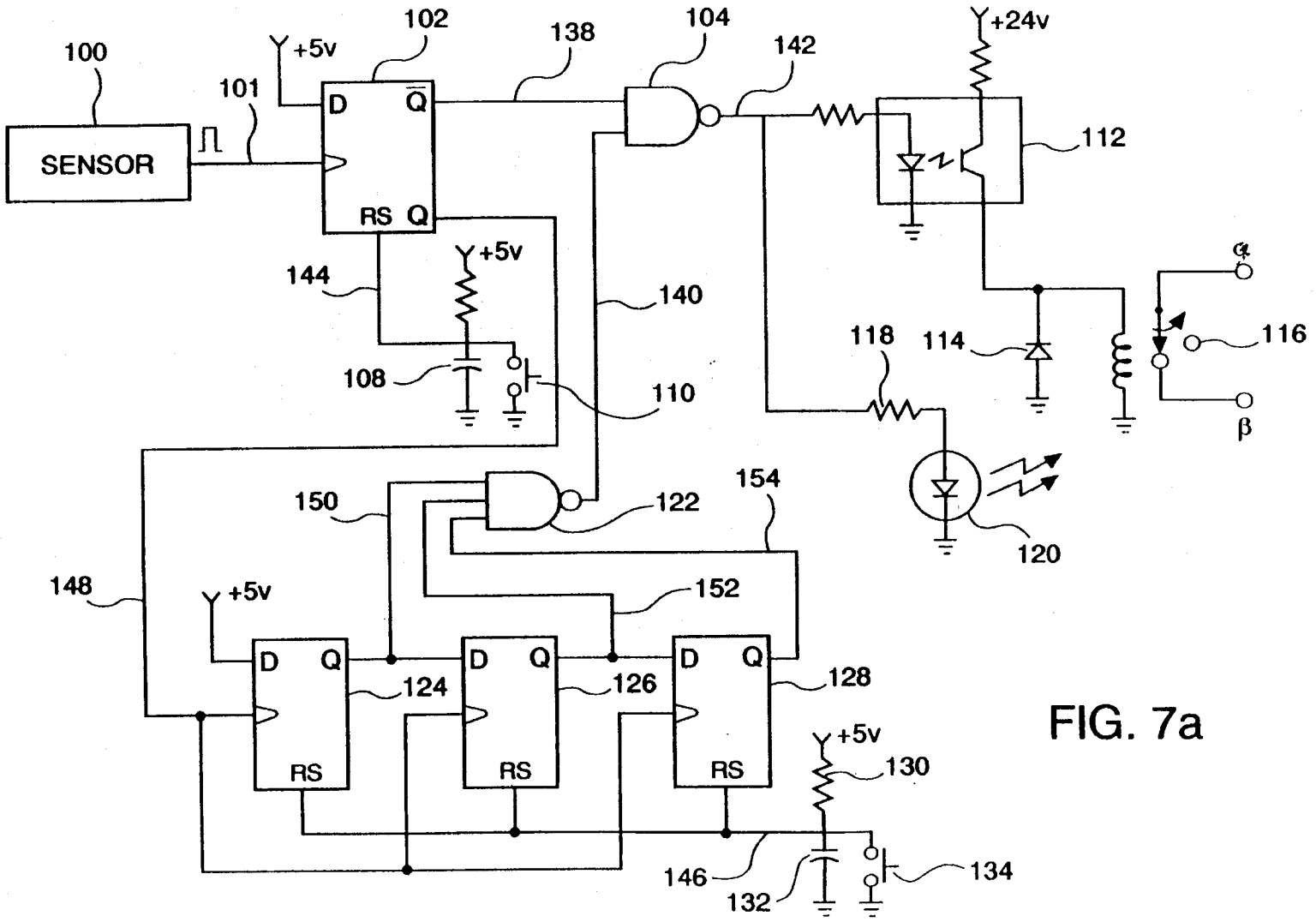
FIG. 7A is a schematic representation of an alternate embodiment of the system of the present invention.

Turning now to FIG. 7A, a schematic diagram of a circuit which implements the features described in FIG. 6 is shown. Upon power-up of the system, flip flop 102 is reset via resistor 106 and capacitor 108 such that the Q output 148 is a logic zero and the $\overline{Q}$ output 138 is a logic one. Similarly, flip flops 124, 126 and 128 are reset upon power-up by resistor 136 and capacitor 132 making their respective Q outputs 150, 152 and 154 a logic zero. Thus, each of the inputs to AND gate 122 are logic zero, yielding an output 140 which is logic one. Thus, during this power-up state, $\overline{Q}$ output 138 of flip flop 102, which is logic one, is input to NAND gate 104 along with NAND 122 output 140, which is logic one, yielding output 142, which is logic zero. This logic zero level at line 142 is coupled through optoisolator 112 to normally closed relay 116 which remains in the closed position. Clamping diode 114 is present to dissipate transient voltages generated by the solenoid of relay 116. Light emitting diode 120 is similarly in a deactivated state when line 142 is at a logic zero level.

Figure 7B:
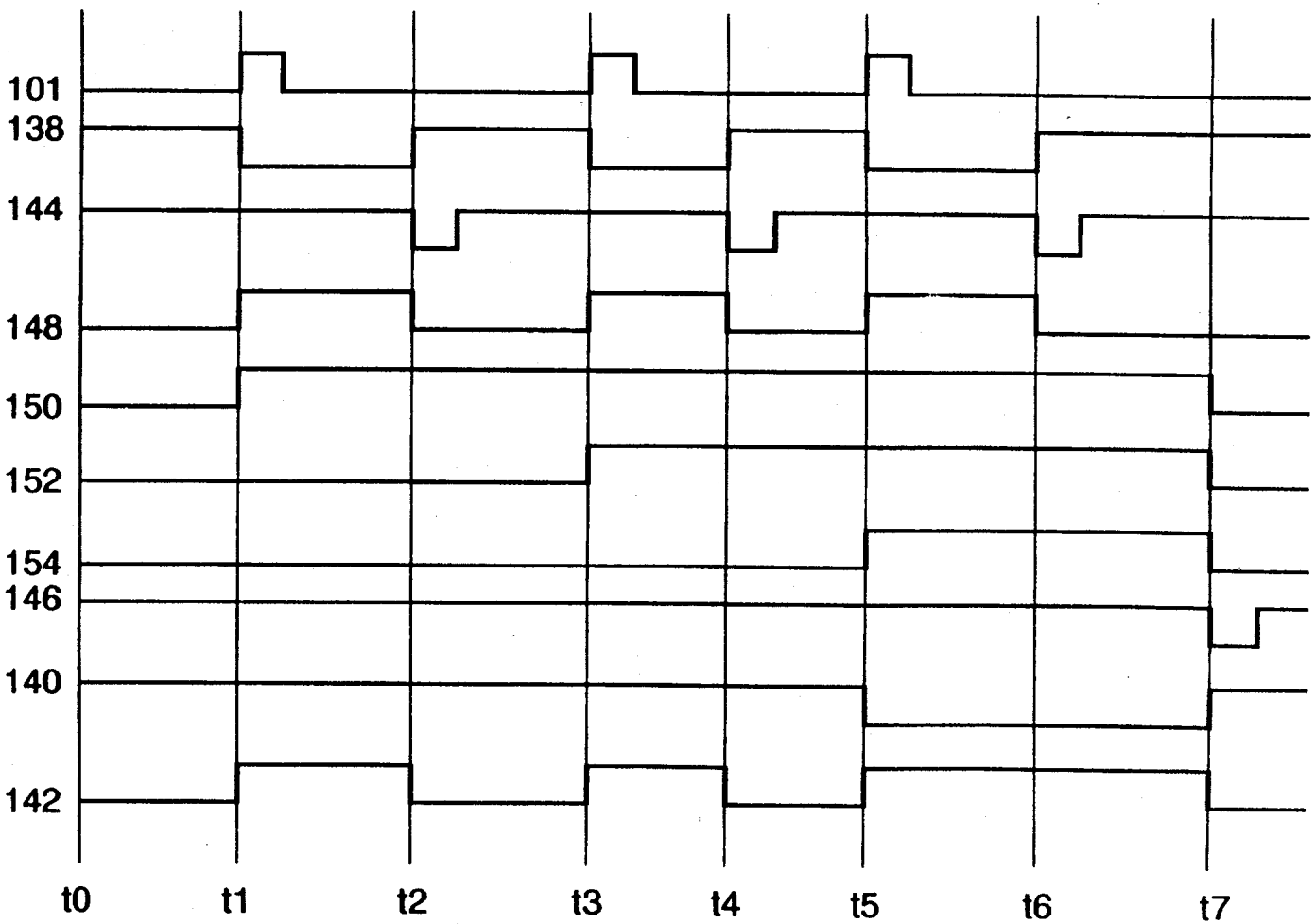
FIG. 7B is a timing diagram which describes the operation of the circuit in FIG. 7A.

The logic states of the various inputs and outputs of the circuit are represented by the timing diagram shown in FIG. 7B. The initial power-up states of the system are represented by time $T_0$. The remainder of the timing diagram illustrates the operation of the circuit under various conditions.

At time $T_1$ sensor 100 generates a positive voltage pulse indicating the presence of a gas above a selected threshold or an alarm status for one or more smoke alarms. The rising edge of the pulse on line 101 triggers a latching of a logic one on the $\overline{Q}$ output 148 of flip flop 102 and a logic zero on Q output 138. This logic zero to logic one transition of line 148 triggers the latching of a logic one level of Q output 150 of flip flop 124, as well as the latching of logic zero levels on Q outputs 152 and 154 of flip flops 126 and 128, respectively. The output 140 of NAND gate 122 is thus a logic one. The logic one from output 140 is combined with the logic zero from output 138 which is input to NAND gate 104. This yields an output 142 which is a logic one. This logic one voltage supplies current to light emitting diode 120 via current limiting resistor 118. This serves to illuminate light emitting diode 120 indicating the presence of a fault condition. Further, the logic one voltage at line 142 activates the solenoid of relay 116 via optoisolator 112, causing the contacts to open. Thus, at this point nodes α and β are open circuited. The open circuit condition of nodes α and β could be used to disable the heating or heating/air conditioning unit such that the operation of the unit would cease.

The disabled state of the heating or heating/air conditioning unit is maintained until switch 110 is activated. When the switch is closed, reset input 144 of flip flop 102 is connected to ground. This changes Q output 148 to a logic zero and $\overline{Q}$ output 138 to a logic one. The inputs 138 and 140 to NAND gate 104 are thus both high yielding a low output on 142 which deactivates LED 120 and the solenoid to relay 116 causing nodes α and β to be once again connected.

At time $T_3$, a second sensor pulse is generated on line 101 corresponding to a second fault condition. This fault condition causes line 142 to take on a logic high level which illuminates LED 120 and opens relay 116 as before. Further, Q output 152 of flip flop 126 takes on a logic zero level in a manner similar to the transition of output 150 of flip flop 124 at time $T_1$.

If switch 110 is momentarily closed at time $T_4$, this again serves to deactivated LED 120 and relay 116 in a manner similar to the actions of the circuit at time $T_2$. If, however, a third sensor pulse is received on line 101 at time $T_5$, and the relay 116 is opened and LED 120 activated, the circuit cannot be reset by a third activation of switch 110. The sensor pulse at $T_5$causes Q output 154 of flip flop 128 to take on a logic one level. Thus, the output 140 of NAND gate 122 is a logic zero. This logic zero input to NAND gate 104 insures that no actions of flip flop 102 will be able to change the state of output 142 from its logic one level. The third activation of switch 110 at time $T_6$ causes Q output 148 of flip flop 102 to switch to a logic zero level and $\overline{Q}$ output 138 to switch to a logic one level. However, the combination of a logic one level on line 38 and a logic zero level on line 140 causes the output 142 of NAND gate 104 to be logic one. The only way to deactivate the solenoid to relay 116 and the LED 120 is to momentarily press switch 134 which couples reset line 146 to flip flops 124, 126 and 128 to ground. This resets the Q outputs 150, 152 and 154 of flip flops 124, 126 and 128, respectively, to the logic zero level which they attained upon power up of the system. Thus, the relay 116 and LED 120 can be deactivated twice again by switch 110 before switch 134 and activation of switch 134 is required to reset the circuit.

Figure 8:
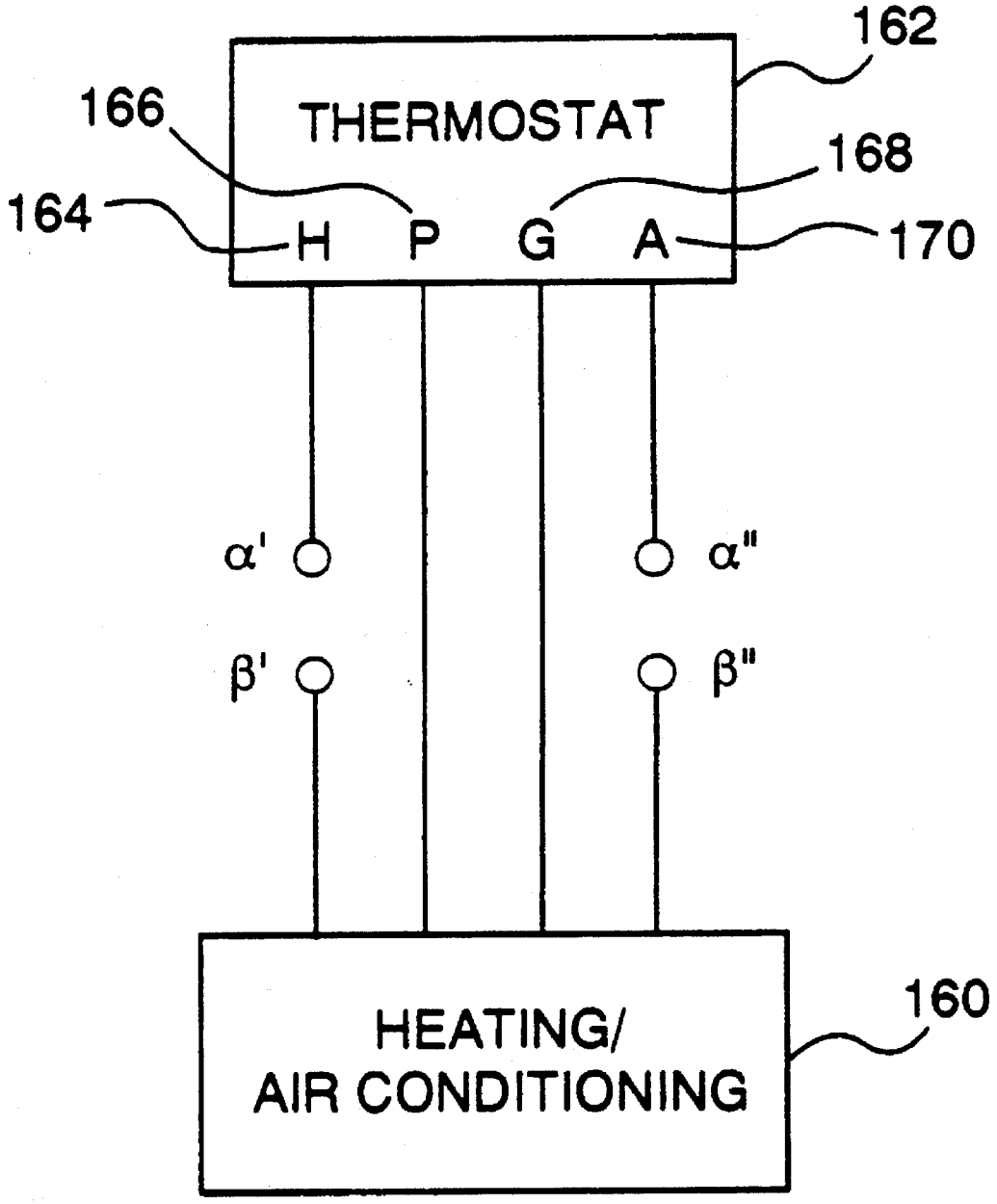
FIG. 8 is a block diagram representation of a standard heating/air conditioning unit and thermostat with connections to the system of one embodiment of the present invention.

Turning now to FIG. 8, a common interconnection between the heating/air conditioning unit 160 and a thermostat 162 is shown. Four lines labelled 164, 166, 168 and 170 interconnect these two units.

Line 66 couples voltage from the heating/air conditioning unit 160 to the thermostat. This voltage is commonly 24 volts AC. Line 168 is circuit ground from the heating/air conditioning unit 163. Lines 164 and 170 are control lines for the heating and air conditioning functions respectively of the heating/air conditioning unit 160.

The thermostat operates by connecting line 166 to line 164 if the ambient temperature of the thermostat falls below a selected temperature threshold and if the thermostat is in a heating mode. Alternatively, line 166 is connected to control line 170 if the ambient temperature of the thermostat rises above a selected temperature threshold and if the thermostat is in a cooling mode.

The heating operation of the heating/air conditioning unit 160 can be disabled by providing an open circuit to nodes α' and β' by means of a circuit such as the circuit shown in FIG. 7. Similarly, the cooling operation of the heating/air conditioning unit 160 can be disabled by providing an open circuit to notes α" and β" by means of a circuit such as the circuit shown in FIG. 7.

When the relay is in the closed position, indicative of either no fault condition or a fault condition followed by a valid re-enabling of the circuit shown in FIG. 7, the nodes α and β corresponding to either the connection α' and β', respectively, or the connections α" and β", respectively, will be connected thereby enabling the respective function of the thermostat and therefore the heating or heating/air conditioning unit. Further notice that upon the detecting of a binary logic signal generated by sensor 100 on line 101, relay 116 is opened thereby disabling either the heating operation or the air conditioning operation of heating/air conditioning unit 160 in FIG. 8.

In the preferred mode of operation, a circuit has shown in FIG. 7 implemented with a sensor 100 which is configured for the detection of carbon monoxide would be connected with nodes α and β in FIG. 7 connected to nodes α' and β' as shown in FIG. 8. Thereby, if the concentration of carbon monoxide were detected to be above a selected threshold, the heating operation of the heating/air conditioning unit 160 in FIG. 8 would be disabled. Further, a second circuit similar to the circuit shown in FIG. 7 with sensor 100 configured for the detection of refrigerant, could be connected such that nodes α and β as shown in FIG. 7 would be connected to nodes α" and β" as shown in FIG. 8. Thereby, if a gas concentration were detected which exceeded a selected threshold, the air conditioning function of the heating/air conditioning unit 60 in FIG. 8 could be disabled.

One with ordinary skill in the art will also recognize than heating/air conditioning unit 160 in FIG. 8 could be disabled by means of a circuit such as the circuit shown in FIG. 7A whereby nodes α and β were connected in line of line 116. That is, an open circuit between nodes α and β produced by the control circuit shown in FIG. 7A would supply an open circuit on line 166 whereby the source of power to the thermostat would be disabled. This in turn, would disable the operation of heating/air conditioning unit 160.

One with ordinary skill in the art will further recognize that the circuit shown in FIG. 7A could easily be implemented by means of an algorithm executed by a microprocessor, signal processor, programmable controller or other similar devices.

One with ordinary skill in the art will recognize that the method described by the flow chart in FIG. 7 could easily be modified to encompass a condition whereby two separate sensor outputs are monitored. The first sensor output could correspond to a condition whereby a binary high signal is generated when the gas concentration exceeds a first selected threshold. The second sensor output could generate a logic high level if the gas concentration exceeded a second selected threshold whereby the second selected threshold is higher than the first selected threshold. The first sensor output could be used as in the method described by the flow chart in FIG. 6. In addition, the second sensor output could be used to indicate a more serious fault condition which immediately disabled the operation of the heating or heating/air conditioning unit such that the activation of switch number one would not reenable the operation of the heating or heating/air conditioning unit. Rather, the activation of a third switch, similar to the second switch in that its mode of activation would not be readily apparent to the heating or heating/air conditioning unit user. Further, the functions of this third switch could also be performed by the second switch previously described.

Figure 7C:
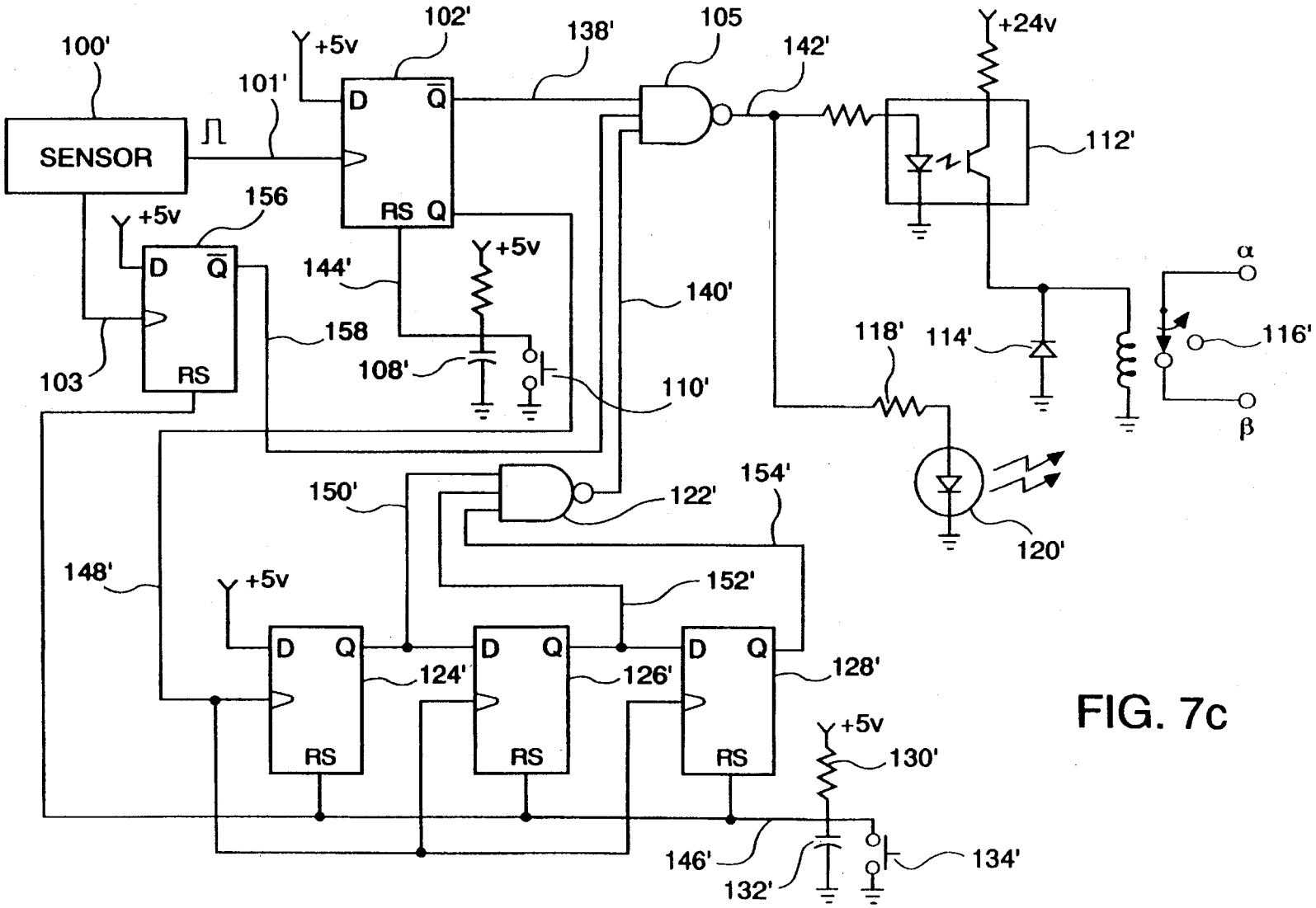
FIG. 7C is a schematic representation of an alternate embodiment of the system of the present invention.

Turning now to FIG. 7C, a sample circuit for implementing this additional function is presented. The circuit of FIG. 7C is identical to the circuit in FIG. 7A (with common elements being labelled with the reference numerals used in FIG. 7A augmented with the prime (') symbol) except for the following modifications. A second output 103 to sensor 100' generates a logic high signal based upon a measured gas concentration which is above a selected threshold which is higher than the selected threshold which corresponds with output 101'. This output 103 is fed to flip flop 156 whose $\overline{Q}$ output 158 is further input to NAND gate 105. Upon power up of the system, $\overline{Q}$ output 158 is high due to the reset function performed by resistor 130' in capacitor 132'. If a high gas concentration is sensed, a logic high binary signal is generated on line 103 which latches a logic one level on $\overline{Q}$ output 158 thereby opening relay 116' and activating LED 120'. Notice that the activation of switch 110' would not re-enable the operation of the controller. Rather, the activation of switch 134'is required to reset flip flop 156 to reenable control operation.

Turning now to FIG. **9*a*, one possible method of interfacing an existing smoke alarm to the controller of the present invention is shown. The audio output 180 of smoke alarm 182 is received by microphone 184. Microphone 184 generates an electrical signal 186 in response to this audio signal. Processor 190 processes electrical signal 186 to generate a logic signal 188 indicative of whether or not the audio output 180 is present from smoke alarm 182**.

Figure 9A:
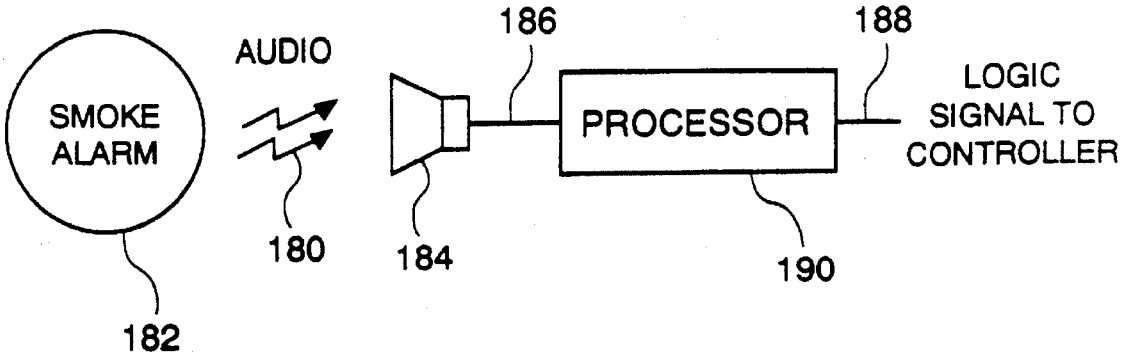
FIG. 9A is a block diagram representation of the smoke detector monitoring system of one embodiment of the present invention.
Figure 9B:
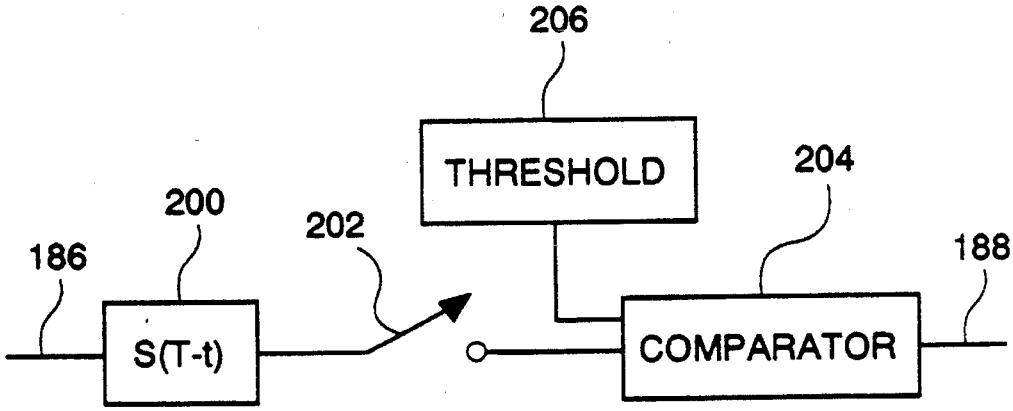
FIG. 9B is a block diagram representation of the smoke detector processor of one embodiment of the present invention.
Figure 9C:
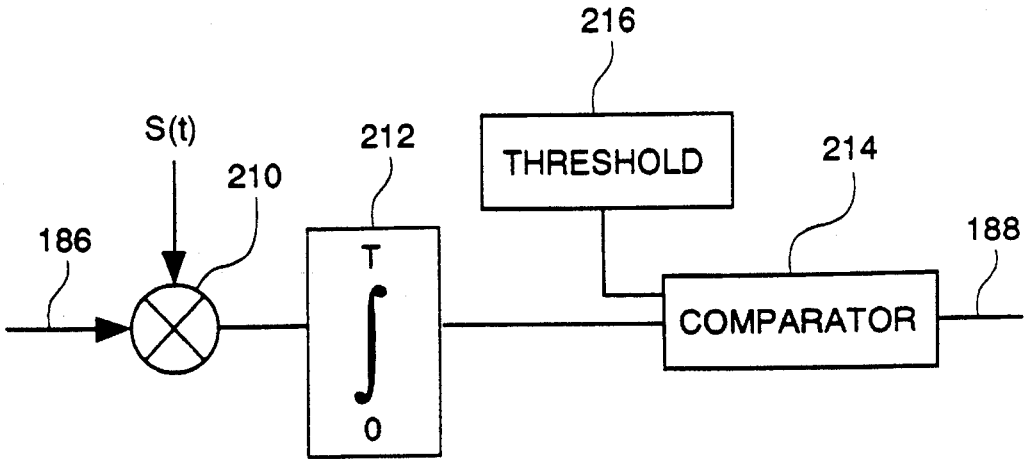
FIG. 9C is a block diagram representation of an alternate embodiment of the smoke detector processor for one embodiment of the present invention.
Figure 9D:
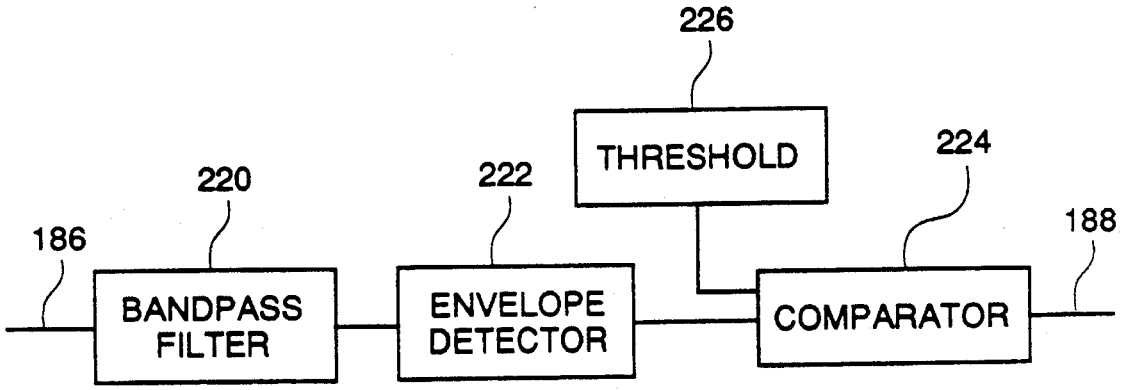
FIG. 9D is a block diagram representation of a second alternate embodiment of the smoke detector processor for one embodiment of the present invention.

FIGS. 9B, 9C and 9D show various options for implementing processor 190. In FIG. 9B, electrical signal 186 is fed to matched filter 200 whose impulse response is given by S(T-t) where S(t) represents the audio signal 180 produced by smoke alarm 182. The output of matched filter 200 is sampled at time t=T by switch 202 and fed to comparator 204. The output of switch 202 is compared with a selected threshold 206 to generate logic signal 188.

An alternate method for implementing processor 190 is shown in FIG. 9C. Electrical signal 186 is multiplied by S(t) by multiplier 210. This result is integrated from time zero to time T by integrator 112. The integrator result is fed to comparator 214 which compares the integrated result to threshold 216 and generates logic signal 188.

A second alternative for implementing processor 190 is shown in FIG. 9D. Electrical signal 186 is fed to band pass filter 220 which is tuned to one or more of the selected frequency components of the audio output 180 of smoke alarm 182. The output of the band pass filter is fed to envelope detector 222 whose output is compared with threshold 226 by comparator 224 to generate logic signal 188.

Those with ordinary skill in the art will recognize that thresholds 206, 216 and 226 would be generated based upon the expected signal levels generated by the audio output of a smoke alarm at the inputs to the comparators in the respective circuits described above. Preferably, these levels would be chosen to be below the minimum expected signal level, yet above the level generated by expected audio noise present in proximity to the smoke alarm or smoke alarms.

Those with ordinary skill in the art will recognize that the systems of the various embodiments of the present invention could include an integral smoke alarm. That is, the system of the present invention could include a smoke alarm circuit which is powered by the power supply of the system. This would eliminate the need for smoke alarm batteries and the various detecting and processing circuits described in FIGS. 9A through 9D. Rather, a logic signal indicative of alarm status of the smoke alarm could be directly fed to the controller of the present invention for disabling the heating or heating/air conditioning unit in response to this alarm condition.

While the best mode for carrying out the invention has been described in detail, those familiar with the art to which this invention relates will recognize various alternative designs and embodiments for practicing the invention as defined by the following claims.

What is claimed is:

1. A control system for a heating/air conditioning unit operating by the combustion of a fuel and by the compression of a refrigerant, the heating/air conditioning unit having a forced-air duct, the system comprising:

a gas sensor placed in a position so as to sample the air in the forced-air duct for generating an electrical signal as a function of the concentration of a first gas in the forced-air duct;

first comparison means responsive to the electrical signal for comparing the first gas concentration to a selected first threshold and for generating an output signal indicative of whether the first gas concentration is above the first threshold;

first control means responsive to the output signal for disabling the heating unit if the first gas concentration is above the first threshold;

counting means for counting the number of times the heating unit has been disabled;

first interface means for receiving a first reset indication from a user; and first enabling means responsive to the first interface means and the counting means and in electrical communication with the first control means for enabling the operation of the heating unit upon receipt of the first reset indication if the number of times the heating unit has been disabled is below a selected number.

2. The system of claim 1 wherein the first enabling means includes means for excluding incidents where the heating unit was disabled which are older than a selected age when calculating the number of times the heating unit has been disabled.

3. The system of claim 1 further comprising:

second interface means for receiving a second reset indication from a user; and second enabling means responsive to the second interface means and in electrical communication with the first control means for enabling the operation of the heating unit independent of the number of times the heating unit has been disabled.

4. The system of claim 1 wherein the first gas is the fuel.

5. The system of claim 1 wherein the first gas is carbon monoxide.

6. The system of claim 1 wherein the first gas is the refrigerant.

7. The system of claim 1 wherein the first gas is radon.

8. The system of claim 1 further comprising:

indicator means in electrical communication with the first comparison means for indicating that the first gas concentration is above the first threshold.

9. A control system for a heating/air conditioning unit, the system comprising:

monitoring means for monitoring a smoke alarm having an alarm status and for generating an alarm signal indicative of the alarm status;

first control means responsive to the alarm signal for disabling the heating unit if the smoke alarm indicates an alarm status;

counting means for counting the number of times the heating unit has been disabled;

first interface means for receiving a first reset indication from a user;

first enabling means responsive to the first interface means and the counting means and in electrical communication with the first control means for enabling the operation of the heating unit upon receipt of the first reset indication if the number of times the heating unit has been disabled is below a selected number.

10. The system of claim 9 further comprising:

second interface means for receiving a second reset indication from a user; and second enabling means responsive to the second interface means and in electrical communication with the first control means for enabling the operation of the heating unit independent of the number of times the heating unit has been disabled.

11. The system of claim 9 wherein the monitoring means comprise coupling means in electrical communication with the smoke alarm for coupling a alarm signal generated by the smoke alarm indicative of alarm status to the control means.

* * * * *